US007154379B2

(12) United States Patent
Reed

(10) Patent No.: US 7,154,379 B2
(45) Date of Patent: Dec. 26, 2006

(54) PREMISE EVACUATION SYSTEM

(76) Inventor: David L. Reed, 1232 Lakeview Dr., Eustis, FL (US) 32726

( * ) Notice: Subject to any disclaimer, the term of this patent is extended or adjusted under 35 U.S.C. 154(b) by 0 days.

(21) Appl. No.: 10/800,586

(22) Filed: Mar. 15, 2004

(65) Prior Publication Data

US 2004/0201470 A1 Oct. 14, 2004

Related U.S. Application Data

(60) Provisional application No. 60/454,901, filed on Mar. 13, 2003.

(51) Int. Cl.
*G08B 17/00* (2006.01)

(52) U.S. Cl. ..... 340/286.05; 340/293; 340/326; 340/332; 340/384.1

(58) Field of Classification Search ..... 340/286.05, 340/326, 332, 331, 577, 293, 815.4, 286.11, 340/628, 691, 384.1; 362/227
See application file for complete search history.

(56) References Cited

U.S. PATENT DOCUMENTS

| | | | | |
|---|---|---|---|---|
| 3,511,933 | A | 5/1970 | Holmes | |
| 3,601,540 | A | 8/1971 | Bryan | 379/40 |
| 3,925,763 | A | 12/1975 | Wadhwani et al. | 340/825.36 |
| 3,969,720 | A * | 7/1976 | Nishino | 340/815.69 |
| 4,280,123 | A | 7/1981 | Right et al. | 340/384 E |
| 4,531,114 | A * | 7/1985 | Topol et al. | 340/539.1 |
| 4,754,266 | A * | 6/1988 | Shand et al. | 340/691.2 |
| 4,893,324 | A * | 1/1990 | Scown | 379/40 |
| 5,343,509 | A | 8/1994 | Dounies | 379/40 |
| 6,198,390 | B1 | 3/2001 | Schlager et al. | 340/540 |
| 6,402,031 | B1 | 6/2002 | Hall | 235/400 |
| 6,518,878 | B1 | 2/2003 | Skoff | 340/506 |
| 6,553,100 | B1 * | 4/2003 | Chen et al. | 379/37 |
| 6,646,545 | B1 * | 11/2003 | Bligh | 340/286.05 |
| 6,693,534 | B1 * | 2/2004 | Costa et al. | 340/531 |
| 6,873,256 | B1 * | 3/2005 | Lemelson et al. | 340/539.1 |
| 2001/0040501 | A1 * | 11/2001 | Right et al. | 340/331 |

* cited by examiner

*Primary Examiner*—Brent A. Swarthout
(74) *Attorney, Agent, or Firm*—The Livingston Firm; Edward M. Livingston; Angela M. Miller

(57) ABSTRACT

An evacuation system using a combination of elements, such as an on-site weather station (2), a computer system (1) with proprietary software, sensors and other elements to determine a safe direction of evacuation from a premises (11) in case of a threat, use indicators to determine the direction of evacuation and notification of parties external to the premises (11) of evacuation.

5 Claims, 3 Drawing Sheets

PREMISE EVACUATION SYSTEM

CROSS-REFERENCE TO RELATED APPLICATIONS

This application claims the benefit of provisional application Ser. No. 60/454,901, dated Mar. 13, 2003.

BACKGROUND OF THE INVENTION

This invention relates to evacuation systems for buildings and other premises, and more particularly to an evacuation system which employs visual and audio means to direct occupants to a safe location depending on threat location, weather and other conditions.

Historically, evacuation systems and methods used for premises, such as those typically used in fire alarm drills, tornado warnings, bomb warnings and other threats, employ the same pattern, which is normally to direct occupants from a building in the same direction through the same exit or exits, regardless of the type or location of the threat. Unfortunately, such systems can result in the occupants being evacuated in the direction of and into the threat, which could result in the injury or death of the occupants.

After Sep. 11, 2001, current evacuation systems became obsolete. A more sophisticated and intelligent system was needed.

The present invention is a state-of-the-art directional evacuation system that overcomes the problems of current evacuation systems. The system of the present invention displays and enunciates the direction that occupants should follow when evacuating a building or premises along with notifying external first-responders, such as police, fire department and paramedics, by established secure or insecure technologies, including but not limited to the public telephone system, e-mail, pager network, Internet, cell and satellite communications. Multiple link systems of the present invention can be utilized over wide areas for evacuation purposes. Even entire regions can be protected by linking multiple protected complexes. Secure protocols are used to safely communicate evacuation reasons and directions to external responders such as police, fire and rescue and hazardous materials teams, among others.

The present system is activated by onsite or offsite personnel or external emergency management agencies using various technologies described herein. The system can even be self-activating through the use of both onsite and offsite sensors and sensor rays. The evacuation direction is calculated by the system software using direction of the threat, type of threat and weather information obtained through an integrated onsite weather station. The system software then communicates the appropriate evacuation response to the occupants by both visual and audible means through devices placed throughout the protected area.

The prior art includes the following:

| Patent No. | Inventor | Issue Date |
|---|---|---|
| (U.S. unless stated otherwise) | | |
| 6,518,878 | Skoff | Feb. 11, 2003 |
| 6,402,031 | Hall | Jun. 11, 2002 |
| 6,198,390 | Schlager et al. | Mar. 6, 2001 |
| 5,343,509 | Dounies | Aug. 30, 1994 |
| 4,280,123 | Right et al. | Jul. 21, 1981 |
| 3,925,763 | Wadhwani et al. | Dec. 9, 1975 |

-continued

| Patent No. | Inventor | Issue Date |
|---|---|---|
| 3,601,540 | Bryan | Aug. 24, 1971 |
| 3,511,933 | Holmes | May 2, 1970 |

The prior art does not disclose an evacuation system like the present invention. The evacuation system of the present invention preferably has three major components—an onsite weather station, an alarm system associated with five distinct emergency responses and an automatic notification system notifying external first responders and other agencies upon activation of any of the alarms. Unlike other evacuation systems the present system allows the system administrator the ability to determine and direct the direction of the evacuation of occupants during an evacuation event. The direction of evacuation is determined according to threat information, weather data and sensor input. Once the direction of the evacuation is determined, the system activates visual and audible indicators to the evacuees as well as external parties of the direction and threat type through several communication methods and protocols so that external first responders know what challenges will be encountered, thereby resulting in a better overall outcome. A notification list can be maintained for each threat type to provide a more effective crisis response. Threat types may include fire, weather, hostile persons, explosives, nuclear, chemical, biological, among others.

The present evacuation system preferably provides for a minimum of five distinct alarms that correlate to new Twenty-First Century evacuation routes and standards. For simplicity, the alarms correlate to the four cardinal headings: North, East, South and West, which are correlated to numbers 1, 2, 3, and 4, respectively. In other words, the new standard for the direction North will always be exit #1 with displays indicating that exit and the standardized alarm for North will be one beep, which also correlates to the exit number. Therefore, the direction North will be exit 1 with a one-beep alarm; East, exit 2, with a two-beep alarm; South, exit 3, with a three-beep alarm; and West, exit 4, with a four-beep alarm. The fifth alarm is a steady beep tone or other steady signal to indicate that the evacuees are to take shelter or remain inside the premises. In addition, the evacuation direction may also be enunciated through the audio device.

The many object and advantages and preferred embodiments of the present invention will be described below.

SUMMARY OF THE INVENTION

The primary object of the present invention is to provide an evacuation system that determines the direction for safe evacuation.

A further object of the present invention is to provide an evacuation system that communicates the appropriate evacuation direction response to occupants via visual and audible means.

An even further object of the present invention is to provide an evacuation system that considers weather data in determining the evacuation direction and response.

A further object of the present invention is to provide an evacuation system that considers the type of threat in determining the evacuation direction and response.

An even further object of the present invention is to provide an evacuation system that provides for notification of external responders and other agencies of the need for evacuation.

The present invention fulfills the above and other objects by providing an evacuation system that employs several components: a computing system; a weather station; a telephone interface; a network interface; a public address interface; a display interface; and a sensor interface. Additional site-specific needs may require other communication devices, such as cell site transceivers or satellite transceivers. The computing system uses proprietary software to operate and network with other components of the system. The weather station can include any weather monitoring devices capable of rendering wind speed, direction and temperature along with other atmospheric conditions at pre-determined intervals. The phone interface can be any device capable of connection to an analog or digital phone line, which can initiate the dialing of specific telephone numbers and play stored messages at predetermined intervals. Such interfaces would include personal computer modems and assisted dialing devices. The network interface is required for those sites which would use an embedded web server and a closed network for administration purposes.

The public address ("PA") interface may use a site premises local PA system for audible evacuation announcements if available. The public address interface allows the sound to be connected to the system and to play in all zones at the same time.

The display interface consists primarily of a device that can be strategically located in certain areas of the building or on the premises to provide a quick visual indication of the direction for evacuation. The display interface device may have green and red lights to indicate "go here" and "don't go here", respectively. Other indication types may be used in the system depending on the site's specific needs.

Finally, the sensor interface facilitates communication with local, state and national elements and activates appropriate directional evacuation alarms. The sensor interface may include devices that detect movement, fire and smoke, nuclear, chemical and biological threats, among others.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
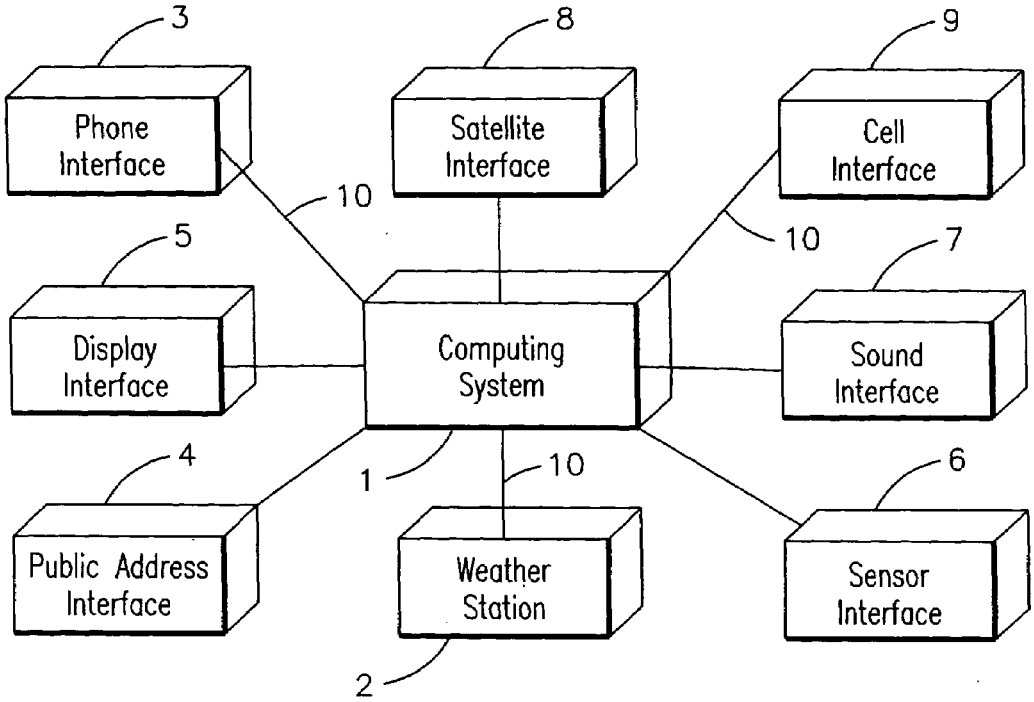
FIG. 1 is a block diagram showing the architecture of a single evacuation system of the present invention.

For purposes of describing the preferred embodiment, the terminology used in reference to the numbered components in the drawings is as follows:

| | |
|---|---|
| 1. | computing system |
| 2. | weather station |
| 3. | phone interface |
| 4. | public address interface |
| 5. | display interface |
| 6. | sensor interface |
| 7. | ground interface |
| 8. | satellite interface |
| 9. | cell interface |
| 10. | network interface |
| 11. | premise (e.g., school) |
| 12. | student evacuee |
| 13. | teacher |
| 14. | internal evacuation threat |
| 15. | north evacuation direction for site A |
| 16. | east evacuation direction for site B |
| 17. | south evacuation direction for site C |
| 18. | west evacuation direction for site D |
| 19. | external evacuation threat |
| 20. | multiple evacuation system nodes |
| 21. | links for system |
| 22. | audible/visual evacuation device |
| 23. | red light |
| 24. | green light |
| 25. | speaker |

In FIG. 1, the architecture of an evacuation system of the present invention for a single location is illustrated comprising a computing system 1, weather station 2, phone interface 3, public address interface 4, display interface 5, sensor interface 7, and site-specific means which may include a cell interface 9 and/or satellite interface 8 for communication purposes. In addition, a sound interface 7 may be utilized to provide an indication of evacuation direction.

The computing system uses proprietary software to operate the various components that are connected by network interface 10 of the system.

The weather station 2 would preferably be an on-site station that would provide wind speed, wind speed direction, temperature and other atmospheric conditions at specified intervals. Although the preferred system would have at least one on-site weather station, multiple weather stations both on and off site could be utilized. The phone interface 3 would be utilized for automatically dialing specific telephone numbers to notify others of emergency. The phone interface 3 may have pre-stored messages depending on the threat or messages recorded at the time of the threat which could be played back to offsite agencies or responders at specific intervals. The public address ("PA") interface 4 could consist of an onsite PA system for making audible evacuation announcements. The display interface 5 can consist of a device like that illustrated and described in relation to FIG. 5 that would provide visual and/or audible indications of the direction for evacuation, preferably green lights to indicate the correct direction and red lights to indicate the wrong direction. The sensor interface 6 may consist of detectors for fire and smoke chemical, biological threats or radiation sensors in the case of nuclear threats. The sensor interface 6 will be networked with the system to facilitate communications with onsite local, state and other agencies and through the computing system could activate appropriate directional evacuation alarms.

Depending on the site specific communication need, various devices may be employed. These could include a cell interface 9, which would have cell site transceivers, and even a satellite interface which would include satellite transceivers for satellite communications. Separate sound interfaces 7 could be utilized which would provide audible indications instead of visual, particularly when PA systems are not available on a site. The sound emitted by such devices would convey direction by fading in the direction of the evacuation; in other words, a loud sound would indicate that it is the wrong direction to evacuate and occupants would then go away from such devices. These devices could be placed in halls, rooms, stairwells or sidewalks, as necessary.

Figure 2:
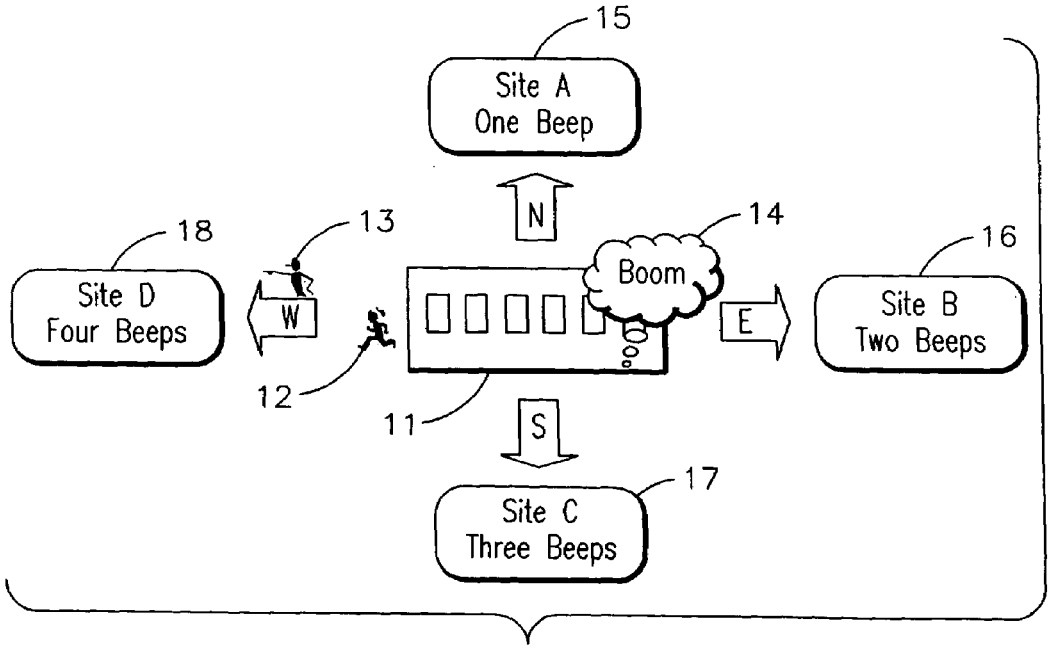
FIG. 2 is a schematic of the evacuation system of the present invention in use for an on-site threat.

In FIG. 2 the present invention is shown as it might be used in cases of an onsite threat. The premises 11 could be a school or other location from which it is necessary to evacuate students 12 away from the onsite threat 14, such as a bomb, fire or other hazard released on the premises. Alarms located inside the premises would render one to four beeps depending on the direction for the safest possible evacuation from the premises. One alarm beep would indicate evacuation to the north 15, perhaps to a pre-determined Site A a sufficient distance from the premises. Two beeps would indicate evacuation to the east 16 to another Site B. Three alarm beeps would indicate evacuation to the south 17 to Site a C. Finally, four alarm would indicate evacuation to the west 18 to a Site D. In the scenario of FIG. 2, the student 12 has been directed by four alarm beeps to evacuate the premises 11 to the west 18. It is contemplated that the system administrator, such as a principal or a teacher 13, may be posted outside the premises 11 in the direction of the evacuation to provide further direction and assistance.

Figure 3:
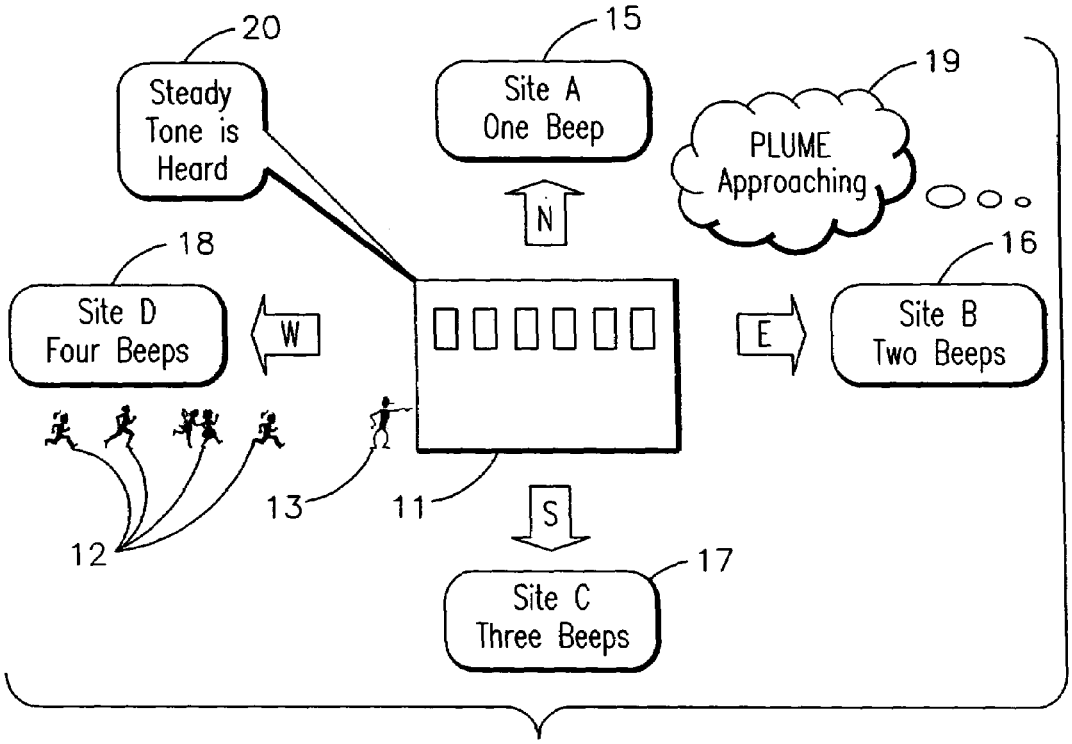
FIG. 3 is a schematic of the evacuation system of the present invention in use when an outside threat requires shelter inside a premises.

In FIG. 3, the evacuation system of the present invention is shown in operation when an evacuation requires the occupants to take shelter inside the premises 11. An external evacuation threat 19, such as an approaching chemical plume, requires that the students 12, who may be outside at recess or other activities, seek shelter within the premises 11 is indicated by a steady alarm 20, students 12 or other occupants of the premises 11 who are already inside the premises 11 would merely remain inside the premises 11.

Figure 4:
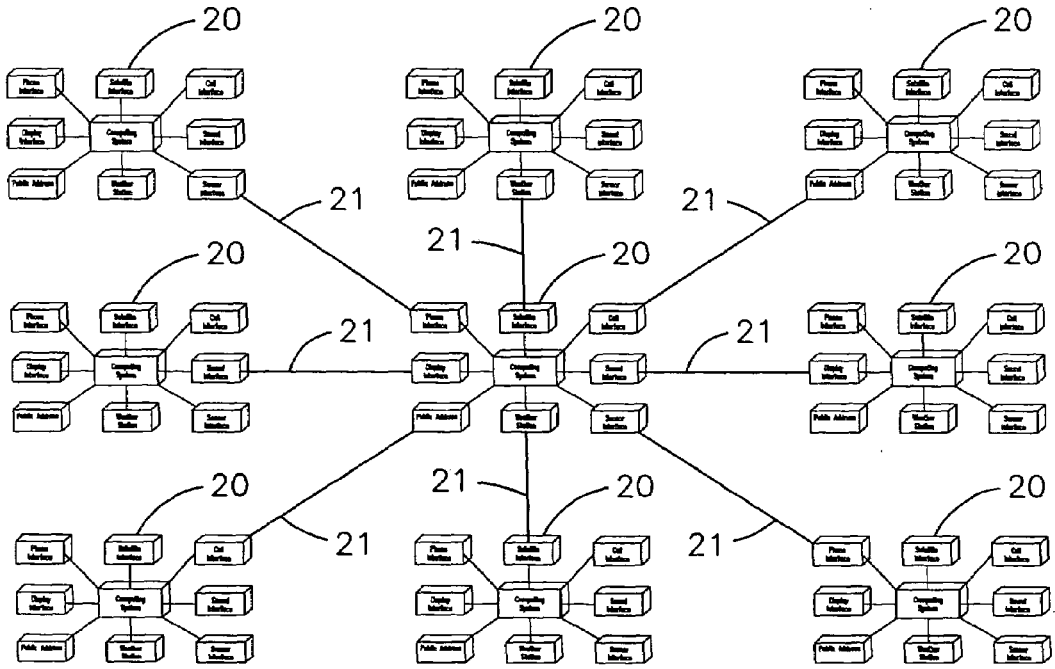
FIG. 4 is a schematic showing use of the present invention for wide area coverage by linked systems.

FIG. 4 illustrates the use of multiple evacuation systems 20 which are networked or linked 21 to form a "blanket" or mesh over an entire area to be protected. The area between each system would be contemplated not to be more than several hundred feet. Applications for a wide-area coverage system would include but not be limited to theme parks, college campus, and larger housing communities. The main difference between a single evacuation system as illustrated in FIG. 1 and a wide area system is that each system or node 20 could be used to direct evacuation in any direction. A master control could use GPS coordinates to determine which direction is most suitable for a particular node 20. Each node would have a control for its own audible and visual direction indicators as well as a notification or call-out list used for an evacuation. In some cases no evacuation would be necessary for a particular node 20, such as if a fire in one building does not affect an area across a complex.

Regional area evacuation systems could be covered by linking multiple protected complexes having multiple system nodes. When one complex has an evacuation event, all linked complexes would be notified of the threat type and direction along with evacuation direction so that response measures could be implemented locally. Government agencies and local crisis management teams could be notified and receive this information so the response could be organized for the safety and well-being of the residents and first responders in those areas. Applications for regional area evacuation systems would include communities, cities, counties, states, or even an entire nation.

Figure 5:
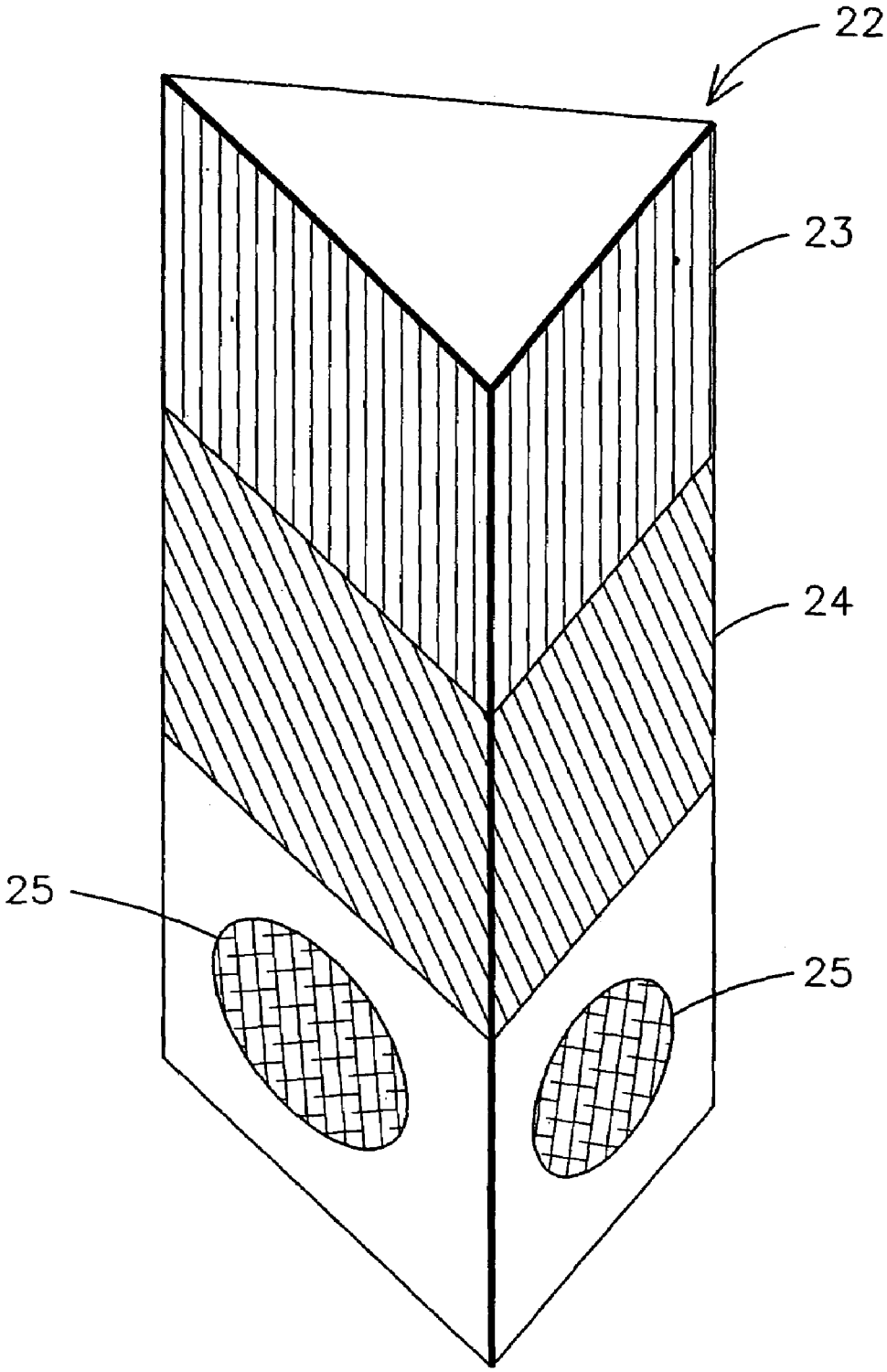
FIG. 5 is a perspective view of a combined audio-visual device which could be used in the evacuation system of the present invention.

In FIG. 5 a combination audible and visual device which could be utilized in the system is illustrated. One or more of these devices could be mounted in various locations throughout the premises 11 or location for use in indicating a direction of evacuation. The devices would preferably have a red light 23 to indicate that one should not proceed in that direction of evacuation and a green light 24 to indicate a safe direction. The device could include speakers 25 to provide the alarm beeps necessary to indicate the direction of evacuation. The devices would preferably be triangular in shape so that occupants could see it and hear the alarm from any direction.

Although only a few embodiments of the present invention have been described in detail hereinabove, all improvements and modifications to this invention within the scope or equivalents of the claims are included as part of this invention.

Having thus described my invention, I claim:

1. An evacuation system comprising:

means for determining a safe direction of evacuation from a premises depending on a location of a threat or other condition; and means for indicating to individuals the direction of evacuation comprising audio indicators including at least one from a group of indicators comprising a public address system and alarm wherein the audio device emits a coded alarm comprising:

one beep to indicate evacuation through one of the predetermined exit site or to the North;

two beeps to indicate evacuation through one of the predetermined exit site or to the East;

three beeps to indicate evacuation through one of the predetermined exit site or to the South;

four beeps to indicate evacuation through one of the predetermined exit site or to the West; and a steady beep to indicate to seek shelter inside premises.

2. An evacuation system comprising:

means for determining a safe direction of evacuation from a premises depending on a location of a threat or other condition; and means for indicating to individuals the direction of evacuation comprising audio indicators including at least one from a group of indicators comprising a public address system and alarm wherein the audio device emits a coded alarm comprisinga fading sound to indicate correct direction for evacuation.

3. An evacuation system comprising:

means for determining a safe direction of evacuation from a premises depending on a location of a threat or other condition; and means for indicating to individuals the direction of evacuation, wherein the means for determining a safe direction of evacuation includes an on-site weather station capable of providing at least wind speed and wind direction.

4. A method of evacuating premises comprising the steps of:

a. ascertaining a safe direction of evacuation depending on a threat location, weather or other conditions;

b. directing evacuation using audio and visual means, wherein said audio means comprises one from a group of indicators comprising a public address system and alarm that emits a coded alarm to indicate the direction of evacuation, wherein the coded alarm comprises one from a group of alarms that includes a number of different beeps including one beep to indicate evacuation through one of the predetermined exit site or the the North;

two beeps to indicate evacuation through one of the predetermined exit site or to the East;

three beeps to indicate evacuation through one of the predetermined exit site or to the South; four beeps to indicate evacuation through one of the predetermined exit site or the the West;

and a steady beep to indicate to seek shelter inside premises;

and a fading sound to indicate the correct direction for evacuation.

5. The method claimed in claim 4 further comprising the step prior to step b of:

using a web interface to initiate the evacuation.

* * * * *